US007555805B2

(12) United States Patent
Lin

(10) Patent No.: US 7,555,805 B2
(45) Date of Patent: Jul. 7, 2009

(54) HOLDING ASSEMBLY FOR SWEEPING AND WRINGING APPARATUS

(76) Inventor: Ming-Hsien Lin, No. 13, Hun Yi St., Pu Tzi Chen Ind Dist, Chia Yi Hsien (TW)

( * ) Notice: Subject to any disclaimer, the term of this patent is extended or adjusted under 35 U.S.C. 154(b) by 288 days.

(21) Appl. No.: 11/514,047

(22) Filed: Aug. 31, 2006

(65) Prior Publication Data

US 2008/0052852 A1 Mar. 6, 2008

(51) Int. Cl.
*A47L 13/14* (2006.01)
*A47L 13/144* (2006.01)

(52) U.S. Cl. ..... 15/119.2; 15/116.2; 15/244.1

(58) Field of Classification Search ..... 15/119.1, 15/119.2, 244.1, 116.1, 116.2, 147.1, 228
See application file for complete search history.

(56) References Cited

U.S. PATENT DOCUMENTS 5,625,918 A * 5/1997 Kieson et al. ..... 15/119.2
7,185,387 B1 * 3/2007 Lin ..... 15/119.1
7,197,785 B2 * 4/2007 Lin ..... 15/119.2

* cited by examiner

*Primary Examiner*—Dung Van Nguyen
(74) *Attorney, Agent, or Firm*—Pro-Techtor Int'l Services; Ralph Willgohs

(57) ABSTRACT

A holding assembly for a sweeping and wringing apparatus comprises a fastening assembly, fastened to a lower end of a holding rod of the sweeping and wringing apparatus, having a chamber which is enclosed by a left wall and a right wall into which insertion holes are bored, an insertion assembly, inserted between the insertion holes and having two cross-shaped insertion heads separated by a spring, and a release assembly, shaped like the letter U and having two end sections with chamfered end faces which wedge-like respectively enter spaces between the left and right walls and the insertion heads when the release assembly is pressed on, with a spring exerting a counterforce, so that a cleaning head of the sweeping and wringing apparatus is easily replaced.

7 Claims, 7 Drawing Sheets

HOLDING ASSEMBLY FOR SWEEPING AND WRINGING APPARATUS

BACKGROUND OF THE INVENTION

1. Field of the Invention

The present invention relates to a holding assembly for a sweeping and wringing apparatus, particularly to a holding assembly for a sweeping and wringing apparatus which allows for easy mounting and replacing of a cleaning head.

2. Description of Related Art

As shown in FIGS. 8-9, a conventional sweeping and wringing apparatus, as disclosed in U.S. patent application No. 11/361,099 comprises a cleaning head 1, a squeezing head 2, a main rod 3, a wringing rod 4, a connecting rod 5, two holding elements 56, two squeezers 57, a holding rod 6, and a holding assembly 7. The cleaning head 1 has a base plate 11 and a cleaning element 12 and is used for sweeping a floor. The base plate 11 has in a middle section thereof two fixing elements 15 with fixing holes 17. The squeezing head 2 is placed on an upper side of the cleaning head 1, partly surrounding the cleaning head 1 in the shape of the inverted letter U, and has an upper part, having a fastening hole 21 and downward extending front and rear parts, each of which have a left arm 23 and a right arm 24 further extending downward, enclosing an opening 27. The main rod 3 is mounted on the fastening hole 21 of the squeezing head 2 and has a lower section with a longitudinal elongated hole 31. The wringing rod 4 is on an inner end thereof hingedly connected with the main rod 3 at a middle section thereof and has an outer end with a grip 41. The connecting rod 5 has an upper end that is hingedly connected with the wringing rod 4 and a lower end that passes through the elongated hole 31 of the main rod 3. The two holding elements 56 are fastened at holes 28 in the left and right arms 23, 24. The squeezers 57 are attached to the two holding elements 56. The holding rod 6 is hingedly connected with the lower end of the connecting rod 5. The holding assembly 7 is fastened to a lower end of the holding rod 6 and comprises two fixing elements 66, fastened to the lower end of the holding rod 6 and each having an insertion hole 67, and an elastic insertion assembly 60. The elastic insertion assembly 60 is inserted between the insertion holes 67 and in turn comprises two insertion heads 61 with cross-like shapes and a spring 65. The two insertion heads 61 each have a blocking ring 62, an outer projection 63 and an inner projection 64. When the elastic insertion piece 60 is inserted between the insertion holes 67, the spring 65 is put over the inner projections 64 and the outer projections 63 enter the insertion holes 67.

For replacing the cleaning head 1, the outer projections 63 are pressed on, allowing to remove the cleaning head 1.

While replacing of the cleaning head 1 is thus readily performed, pressing on both outer projections 63 simultaneously is inconvenient.

SUMMARY OF THE INVENTION

An object of the present invention is to provide a holding assembly for a sweeping and wringing apparatus which is easily assembled.

Another object of the present invention is to provide a holding assembly for a sweeping and wringing apparatus which allows easy replacing of a cleaning head.

The present invention can be more fully understood by reference to the following description and accompanying drawings.

DESCRIPTION OF THE PREFERRED EMBODIMENTS

Figure 8:
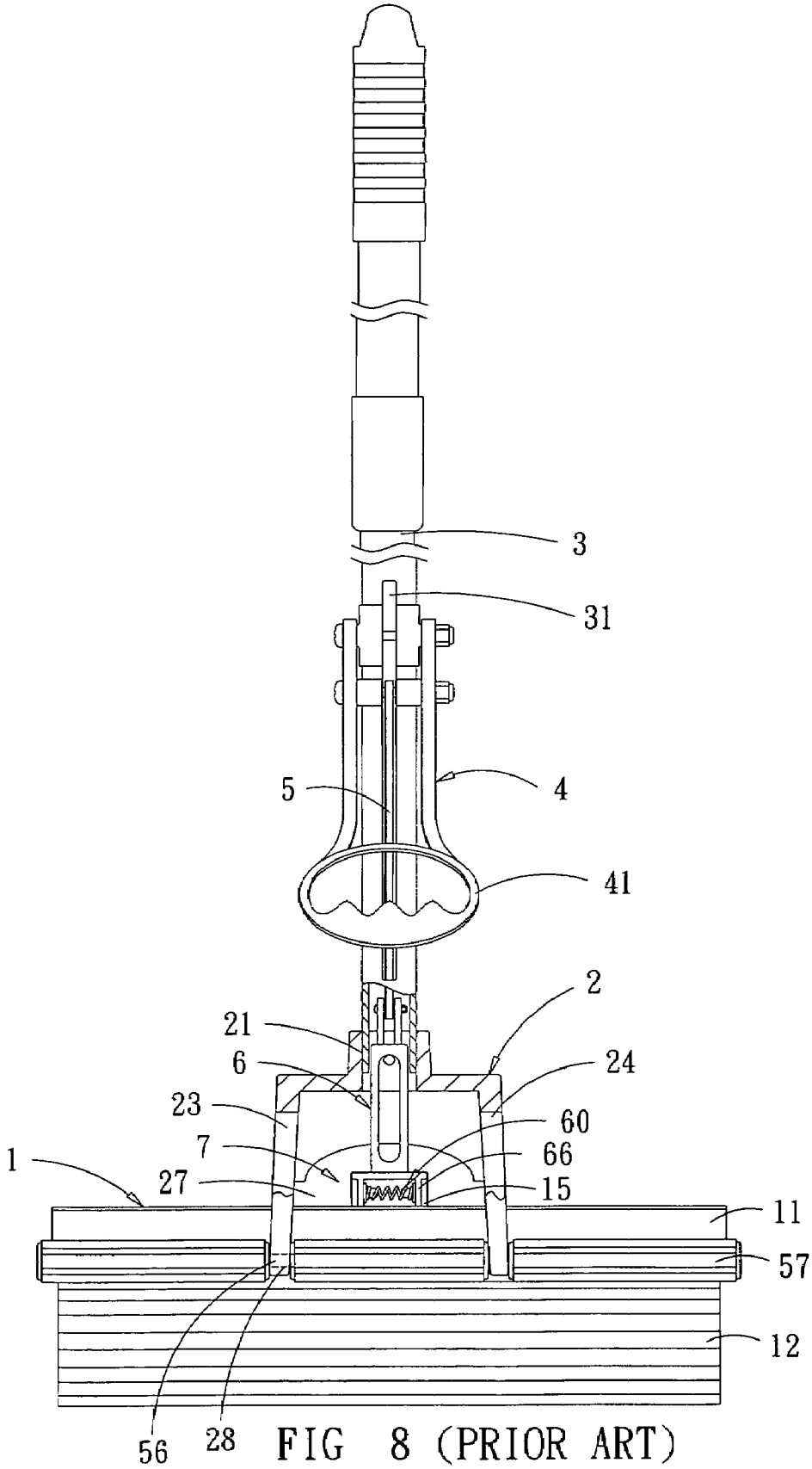
FIG 8 (PRIOR ART)
FIG. 8 (prior art) is a front view of a conventional sweeping and wringing apparatus.
Figure 9:
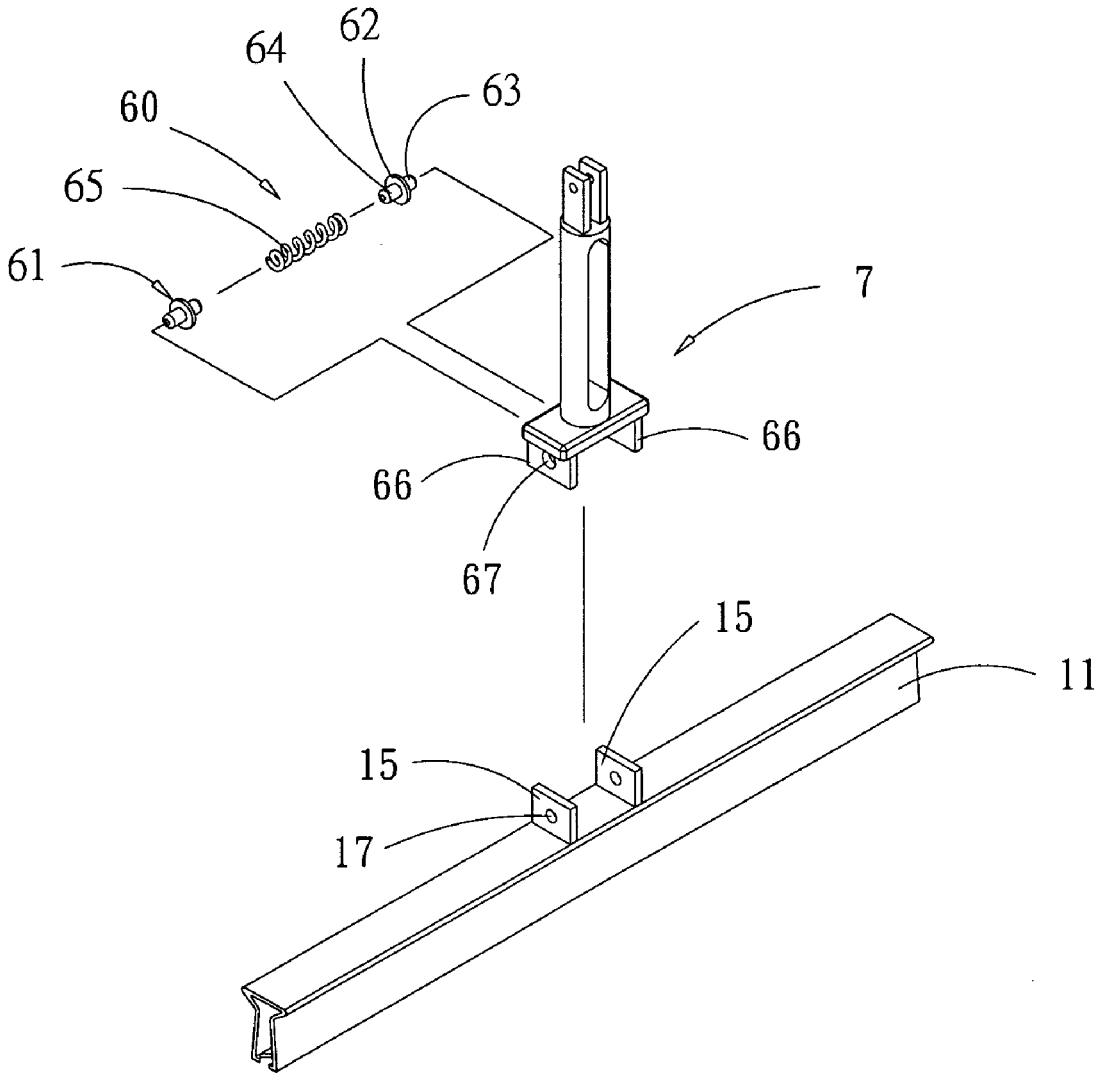
FIG 9 (PRIOR ART)
FIG. 9 (prior art) is an exploded perspective view of a conventional holding assembly for a sweeping and wringing apparatus.

As shown in FIGS. 1-4, the holding assembly of the present invention is used in conjunction with a sweeping and wringing apparatus which comprises structural parts as prior art shown in FIGS. 8 and 9. In a first embodiment, the present invention is a holding assembly 7*a*, comprising a fastening assembly 70, a elastic insertion assembly 8, and a release assembly 9. The fastening assembly 70 is mounted on the lower end of the holding rod 6 and has a chamber 71 enclosed by front and rear walls 72, 74 and left and right walls 73, 75. Openings 761, 762 are cut into the front and rear walls 73, 75 close to left and right edges thereof, and insertion holes 77 are bored into the left and right walls 73, 75. The elastic insertion assembly 8 is inserted between the insertion holes 77 and comprises two insertion heads 81 with cross-like shapes and a spring 82. The two insertion heads 81 each have a blocking piece 83, an outer projection 85 and an inner projection 87. The spring 82 is on opposite ends thereof put over the inner projections 87 of the two insertion heads 81. The outer projections 85 reach through the insertion holes 77. The release assembly 9 is shaped like the letter U, having a middle section and two end sections in each of which a longitudinal incision 94 is cut and which have chamfered end faces 96. The end sections of the release assembly 9 respectively pass through the openings 761, 762 and respectively reach into spaces between the blocking pieces 83 and the left and right walls 73, 75. An inward projection 93 at the middle section of the release assembly 9 fixes an outer end of a spring 95, an inner end of which presses against the front wall 72 of the fastening assembly 70, generating a counterforce to pressing on the release assembly 9.

An outward projection 78 at the front wall 72 of the fastening assembly 70 fixes the inner end of the spring 95.

The ends of the release assembly 9 carry blocking elements 92 which engage with shoulders 763 at outer edges of the openings 761, preventing the release assembly 9 from falling off.

Four protrusions 79 at front and rear edges of the fastening assembly 70 guide a movement of the cleaning head 1. Furthermore, several guiding rails 21 guide a movement of the squeezing head 2, when the cleaning element 12 is wrung.

Guiding ribs 19 at front and rear edges of the left and right walls 73, 75 guide the fixing elements 15 when the cleaning head 1 is mounted and dismounted.

Figure 1:
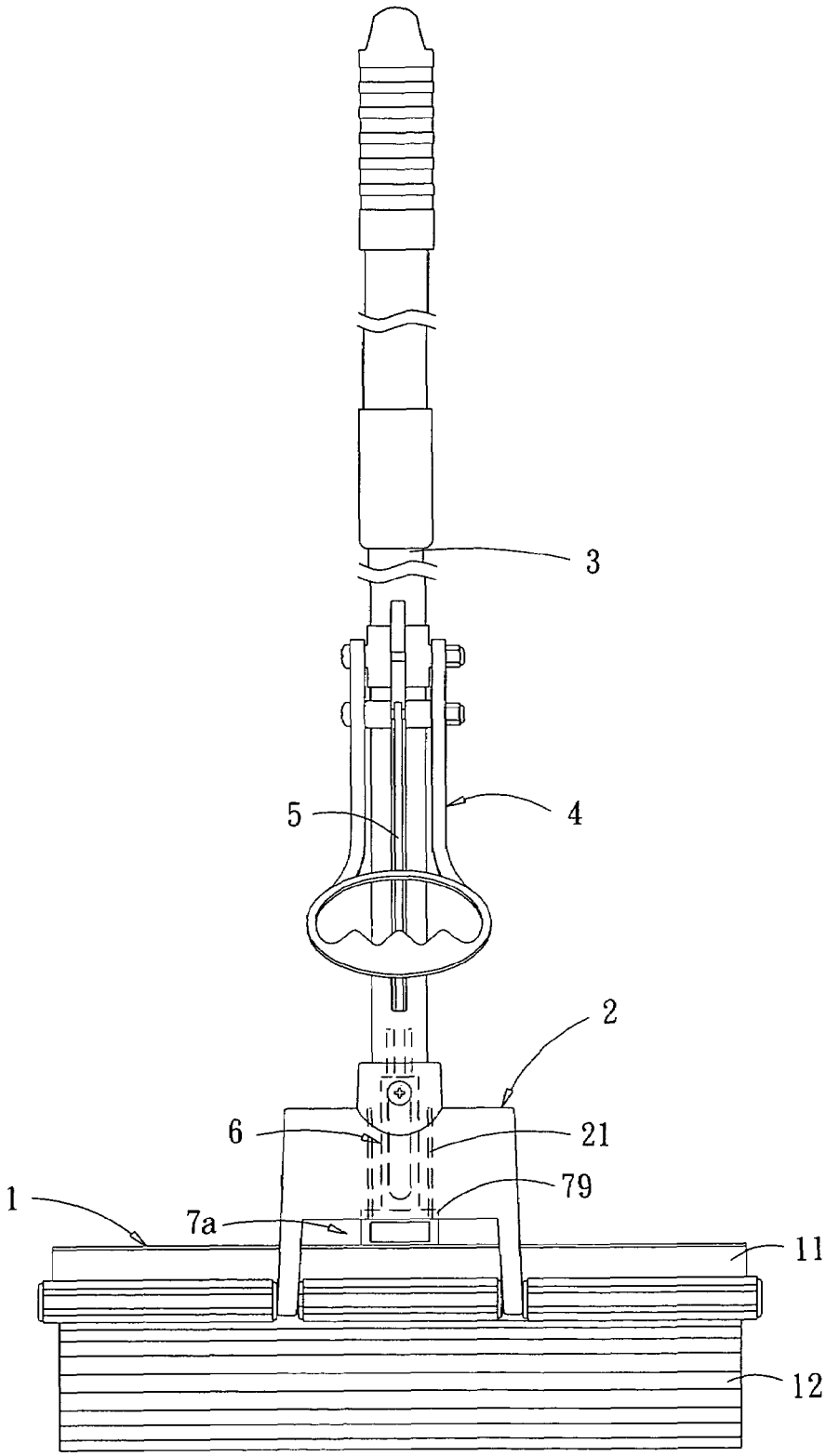
FIG. 1 is a front view of the holding assembly of the present invention in conjunction with a sweeping and wringing apparatus.
Figure 2:
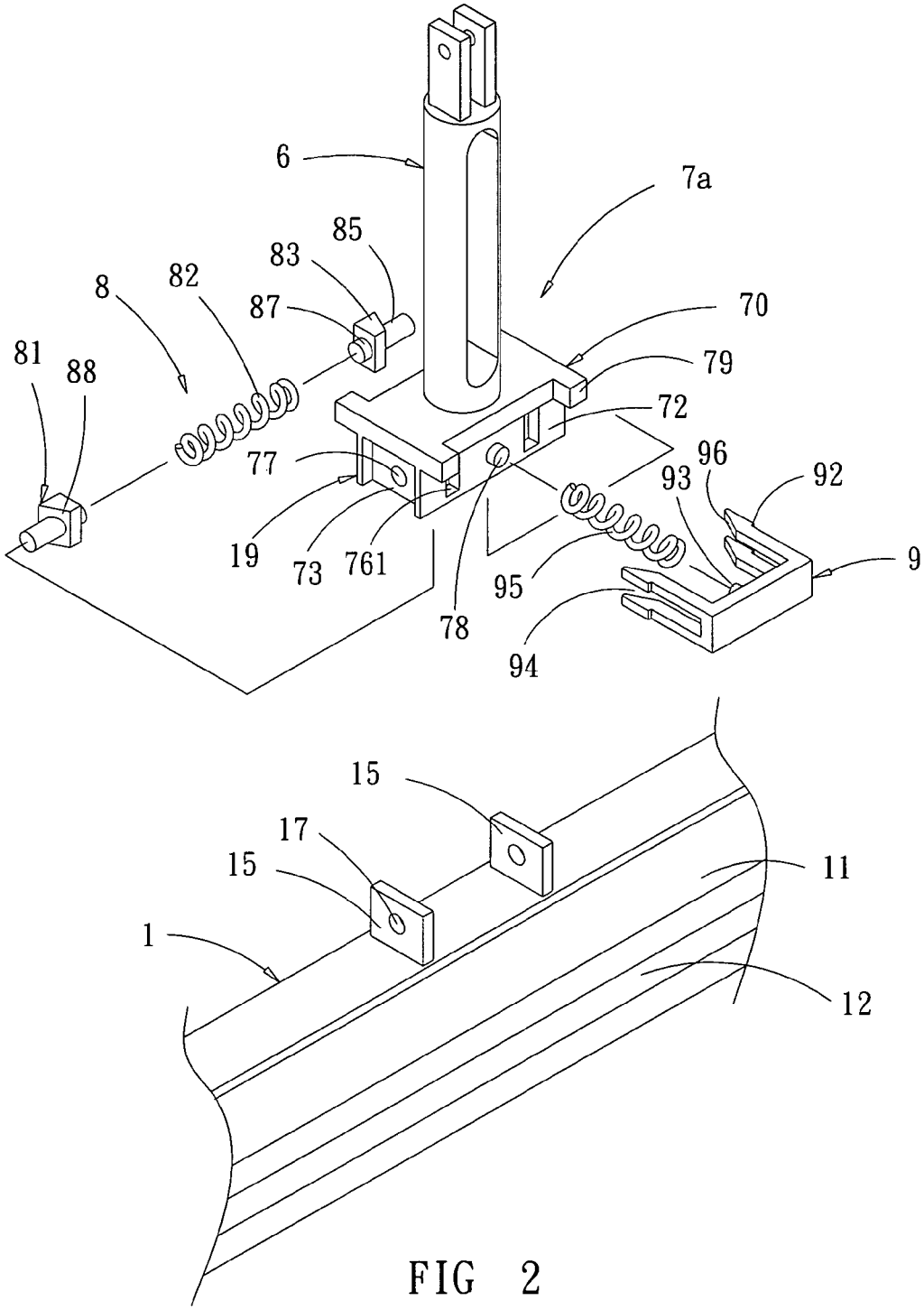
FIG. 2 is an exploded perspective view of the holding assembly for a sweeping and wringing apparatus of the present invention in the first embodiment.
Figure 3:
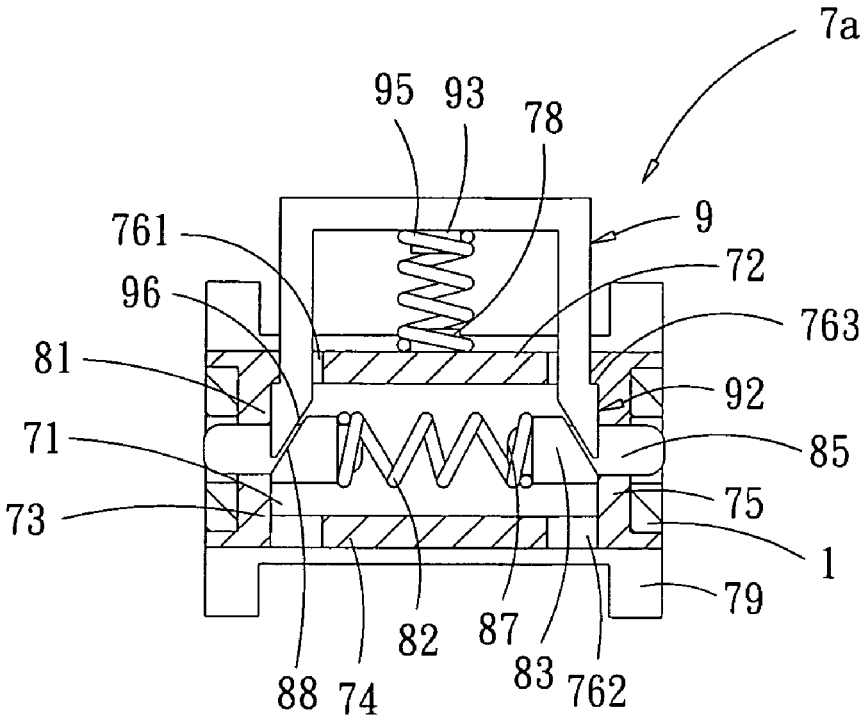
FIG. 3 is a sectional top view of the holding assembly for a sweeping and wringing apparatus of the present invention in the first embodiment.
Figure 4:
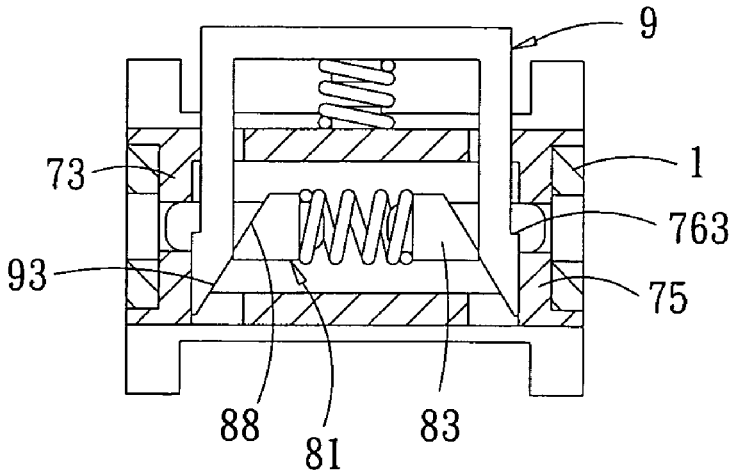
FIG. 4 is a schematic illustration of the present invention in the first embodiment when the release assembly is pressed.

Referring to FIGS. 3 and 4, for replacing the cleaning head 1, the release assembly 9 is manually pressed on, so that the end sections thereof enter the spaces between the blocking pieces 83 and the left and right walls 73, 75 and the chamfered end faces 96 cause the insertion heads 81 to be pressed together.

For having the end sections of the release assembly 9 enter the spaces between the blocking pieces 83 and the left and right walls 73, 75, the blocking pieces have chamfered outer surfaces 88.

Figure 5:
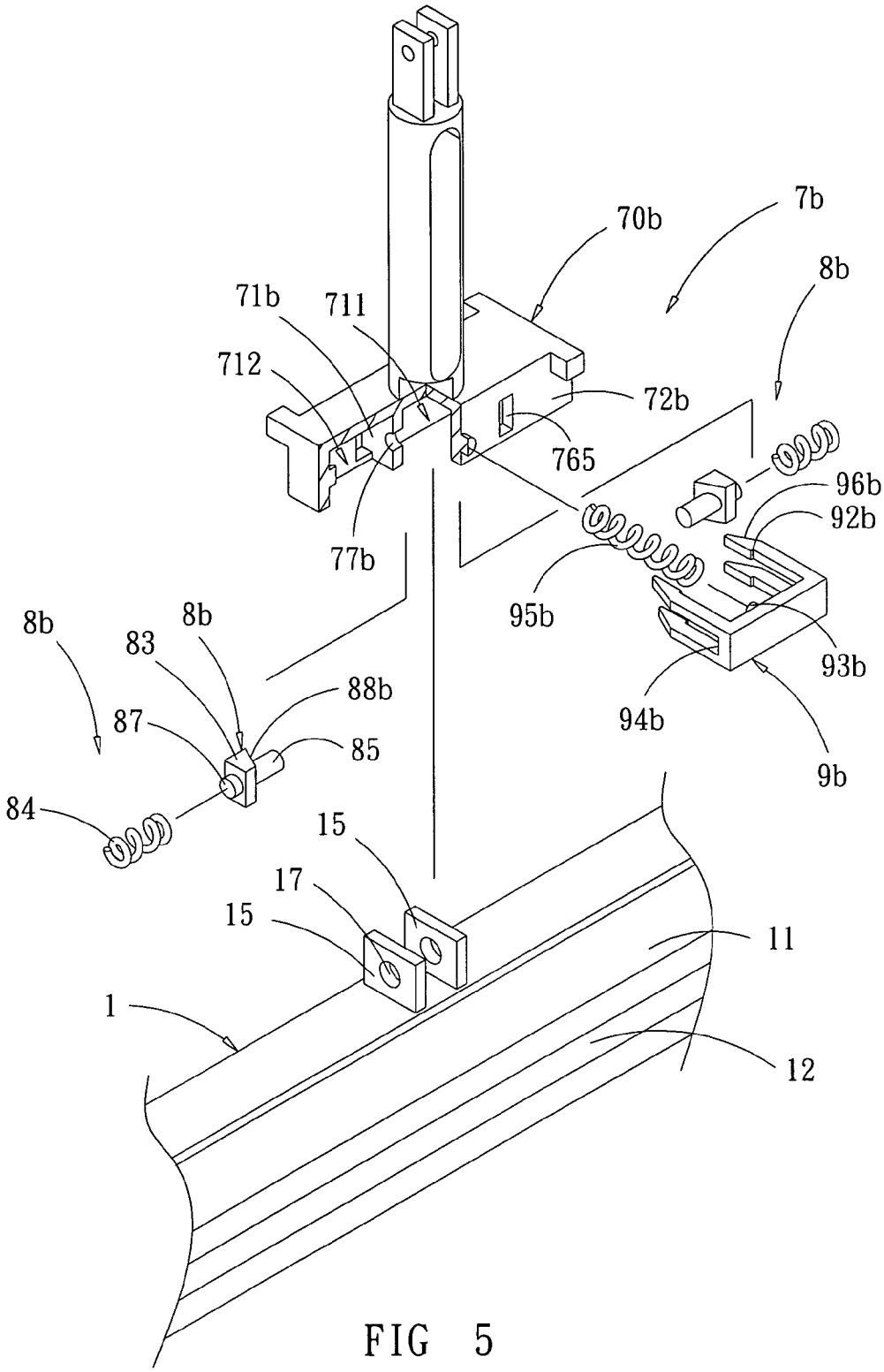
FIG. 5 is an exploded perspective view of the holding assembly for a sweeping and wringing apparatus of the present invention in the second embodiment.
Figure 6:
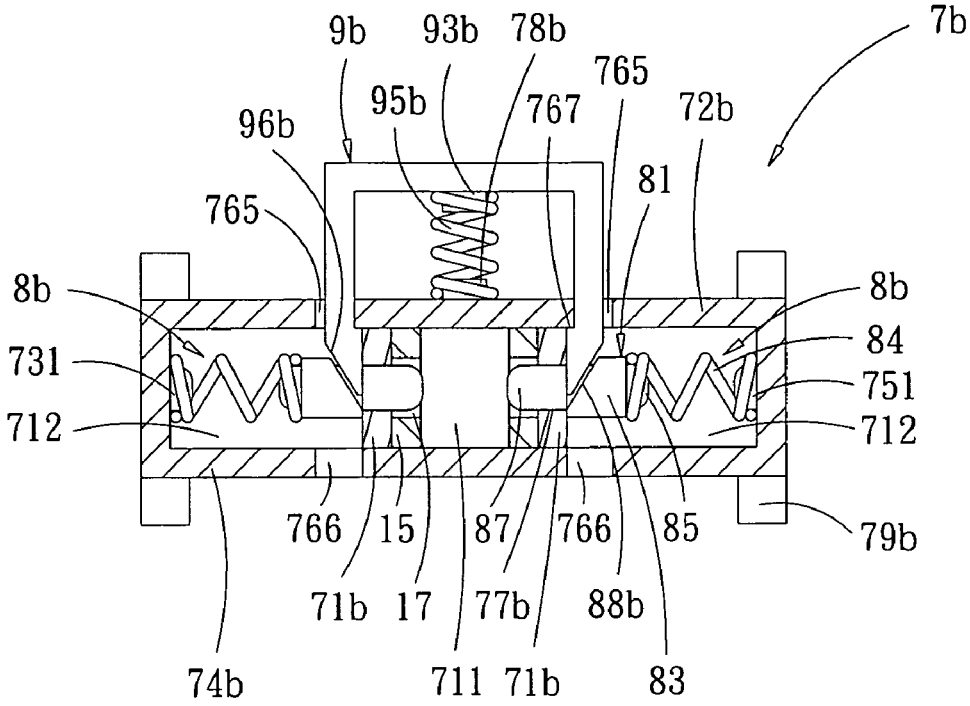
FIG. 6 is a sectional top view of the holding assembly for a sweeping and wringing apparatus of the present invention in the second embodiment.
Figure 7:
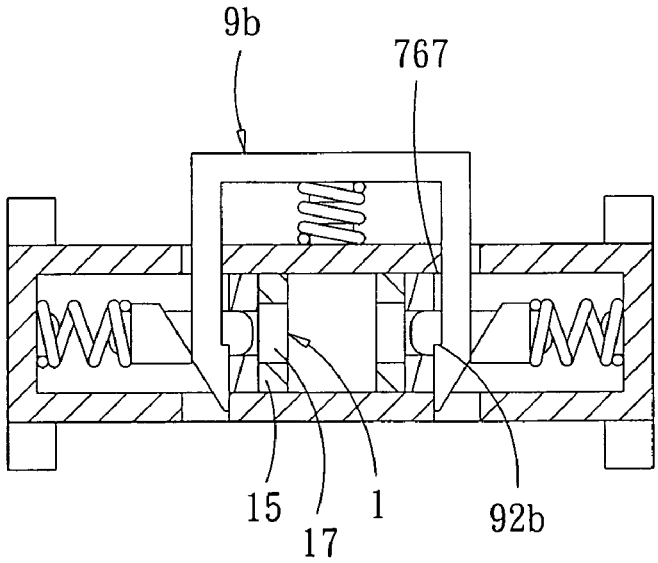
FIG. 7 is a schematic illustration of the present invention in the second embodiment when the release assembly is pressed.

Referring to FIGS. 5-7, the present invention in a second embodiment has a holding assembly 7*b* which works in the same way as the holding assembly 7*a* of the first embodiment. In contrast thereto, the holding assembly 7*b* has a fastening assembly 70*b* with two separating walls 71*b*, so that a middle chamber 711 and left and right chambers 712 are formed. Each of the two separating walls 71*b* has an insertion hole 77*b*, and front and rear walls 72*b*, 74*b* have openings 765, 766 outside the separating walls 71*b*. Two insertion assemblies 8*b* are placed in the left and right chambers 712, respectively, and each comprise one of the insertion heads 81 with cross-like shapes and a spring 84. The insertion heads 81 each comprise the blocking piece 83, the outer projection 85 and the inner projection 87. For each of the two insertion assemblies 8*b*, the spring 84 is put over the outer projection 85, whereas the inner projection 87 reaches through one of the insertion holes 77*b* to the middle chamber 711, and the blocking piece 83 has an chamfered inner surface 88*b*. A release assembly 9*b* is shaped like the letter U, having two end sections into which longitudinal incisions 94*b* are cut and which have chamfered end faces 96*b*. The end sections of the release assembly 9*b* pass through the openings 765 and enter spaces between the separating walls 71*b* and the blocking pieces 83. An inner projection 93*b* at a middle section of the release assembly 9*b* fixes a spring 95*b* at an outer end thereof. An inner end of the spring 95*b* presses against a front wall 72*b* of the fastening assembly 70*b*. Blocking elements 92*b* at the ends of the release assembly 9*b* engage with shoulders 767 at outer edges of the openings 765 preventing the release assembly 9*b* from falling off.

For mounting the cleaning head 1, the fixing elements 15 thereof are inserted into the middle chamber 711, with the fixing holes 17 aligned with the inner projections 87.

For fixing the springs 84, left and right walls 73*b*, 75*b* of the fastening assembly 70*b* carry inward projections 731, 751.

For fixing the inner end of the spring 95*b*, the front wall 72*b* carries an outward projection 78*b*.

Referring to FIG. 7, for replacing the cleaning head 1, the release assembly 9*b* is manually pressed on, causing the insertion heads 81 to retreat into the left and right chambers 712, releasing the cleaning head 1.

The invention claimed is:

1. A holding assembly for a sweeping and wringing apparatus, comprising:

a fastening assembly, fastened to a lower end of a holding rod of said sweeping and wringing apparatus, having a chamber which is enclosed by a front wall, a rear wall, a left wall and a right wall, with openings cut into said front and rear walls close to left and right edges thereof, an insertion hole bored through said left wall and an insertion hole bored through said right wall;

an insertion assembly, having opposite ends that are respectively inserted in said insertion holes of said left and right walls and comprising two generally cross-shaped insertion heads, and a spring inserted between said two insertion heads, with each of said two insertion heads comprising a blocking piece, an inner projection and an outer projection, with said spring being put over said inner projections and said outer projections entering said insertion holes; and a U-shaped release assembly, having a middle section and two end sections with chamfered end faces which respectively enter as wedges into spaces between said left and right walls and said blocking pieces when said release assembly is pressed on, with a spring fixed by an inward projection on said middle section exerting a counterforce.

2. The holding assembly for a sweeping and wringing apparatus according to claim 1, wherein guiding ribs are attached to outer sides of said left and right walls.

3. The holding assembly for a sweeping and wringing apparatus according to claim 1, wherein shoulders are cut into said openings of said front and said end sections of said release assembly carry blocking elements engaged therewith, preventing falling off of said release assembly.

4. The holding assembly for a sweeping and wringing apparatus according to claim 1, wherein said blocking pieces of said insertion heads have chamfered surfaces.

5. The holding assembly for a sweeping and wringing apparatus according to claims 1, wherein a squeezing head of said sweeping and wringing apparatus has several guiding rails and said front wall and said rear wall on outer sides thereof each carry two protrusions which are oriented parallel to said guiding rails.

6. The holding assembly for a sweeping and wringing apparatus according to claim 1, wherein an outward projection is attached to an outer side of said front wall.

7. The holding assembly for a sweeping and wringing apparatus according to claim 1, wherein longitudinal incisions are cut into said end sections of said release assembly.

* * * * *